United States Patent [19]

Fielding et al.

[11] Patent Number: 4,579,150

[45] Date of Patent: Apr. 1, 1986

[54] ANCHORAGE FOR ELASTIC LINGOES OF A LOOM HARNESS

[75] Inventors: Anthony B. Fielding, Stockport; William A. Barlow, Stoke-on-Trent, both of United Kingdom

[73] Assignee: Devoge & Co., Ltd., Manchester, England

[21] Appl. No.: 701,636

[22] Filed: Feb. 14, 1985

[30] Foreign Application Priority Data

Feb. 17, 1984 [GB] United Kingdom ..... 8404171
Nov. 1, 1984 [GB] United Kingdom ..... 8427633

[51] Int. Cl.[4] ..... D03C 13/00
[52] U.S. Cl. ..... 139/90
[58] Field of Search ..... 139/85, 89, 90

[56] References Cited

FOREIGN PATENT DOCUMENTS 1186358 8/1959 France ..... 139/89
2529587 7/1982 France ..... 139/90

*Primary Examiner*—Henry S. Jaudon
*Attorney, Agent, or Firm*—Oblon, Fisher, Spivak, McClelland & Maier

[57] ABSTRACT

An anchorage for elastic lingoes 11 of a loom harness comprises a plurality of rail members 12 each extending across the loom and arranged adjacent and parallel to one another in to a support so as to be separately removable and replaceable with their lingoes 11 still attached. The loom is easier to clean than conventional looms.

4 Claims, 2 Drawing Figures

ANCHORAGE FOR ELASTIC LINGOES OF A LOOM HARNESS

BACKGROUND OF THE INVENTION

1. Field of the Invention

This invention relates to anchorages for elastic lingoes (or "elastics") of a weaving loom harness.

2. Discussion of the Background

Elastic lingoes have been, for some years now, increasingly used in favour of the older weights. Conventionally, an anchorage for the elastics comprises a U-shaped channel section extending across the loom having tranverse pins (transverse to the section, which is to say extending in the warp-wise direction of the loom) mounted in holes drilled in the two uprights of the U-section, a further U-section or like member being provided outside the first to stop the pins falling out. Each pin has a plurality of lingoes looped or tied or clipped to it so that the density of the warp in threads per unit length is several times the density of the pins.

However, the dense packing of the lingoes in the channel section member means that it is difficult to clean. Unfortunately, this is an area where dust tends to accumulate, and furthermore the reciprocatory action of the lingoes tends to compact the accumulation.

SUMMARY OF THE INVENTION

The present invention provides an anchorage which is easier to clean.

The invention comprises an anchorage for elastic lingoes of a loom harness comprising a plurality of rail members each extending across the loom and arranged adjacent and parallel to one another in support means so as to be separately removable and replaceable with their lingoes still attached.

Each said rail member may comprise a rail on to which the lingoes can be looped, tied or clipped and a bar having supports disposed lengthwise thereof for the rail and being adapted for attachment to a transversely extending support member of the loom. Said bar may be apertured to fit bolts disposed along said support member.

An anchorage for elastic lingoes of a loom harness according to the invention will now be described with reference to the accompanying drawings, in which:

DESCRIPTION OF THE PREFERRED EMBODIMENT

Figure 1:
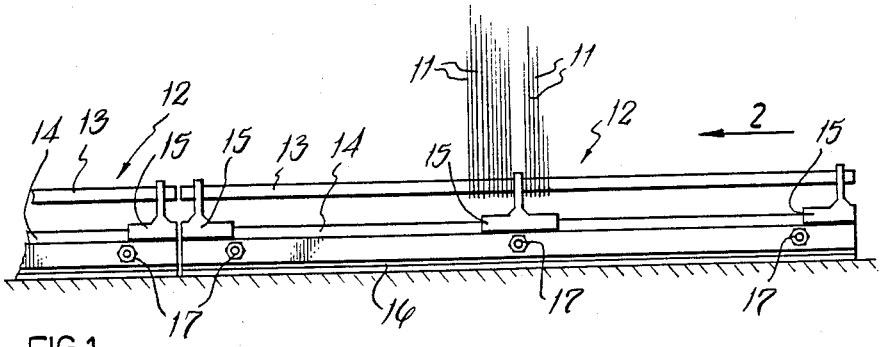
FIG. 1 is an elevational view looking warp-wise of the loom.
Figure 2:
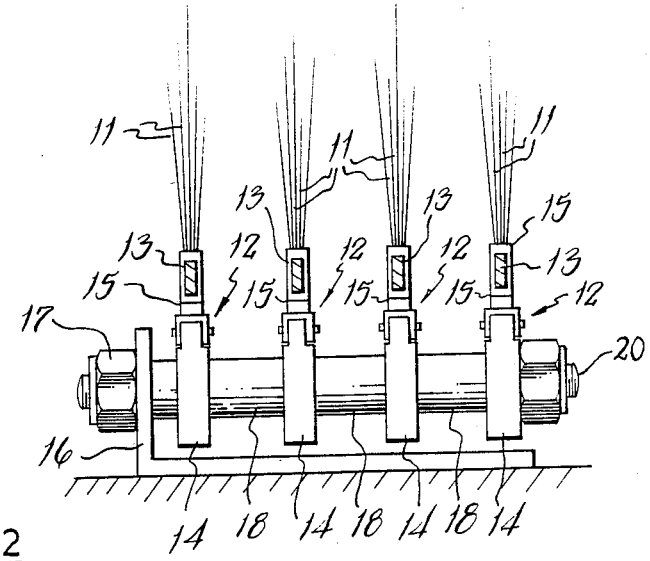
FIG. 2 is an elevational view looking along the arrow 2 of FIG. 1 to a larger scale.

The anchorage for the elastic lingoes 11 of a loom harness comprises a plurality of rail members 12 each extending across the loom and arranged adjacent and parallel to one another in support means so as to be separately removable and replaceable with their lingoes 11 still attached.

Each said rail member 12 comprises a rail 13 on to which the lingoes 11 can be looped, tied or clipped and a bar 14 having supports 15 disposed lengthwise thereof for the rail 13 and being adapted for attachment to a transversely extending support member 16 of the loom.

The bar 14 is apertured to fit bolts 20 and nuts 17 disposed along said support member 16. In the embodiment illustrated, four bars 14 are held on each bolt 20. Each bar 14 extends across half the width of the loom, the bars being disposed symmetrically about the centre line of the loom.

The bars 14 are separated by spacers 18 on the bolts 20, which are held cantilever fashion in the support member 16.

Thus, in this particular arrangement, each half of the loom can be dealt with separately for cleaning—though in wider looms further lateral division might be preferred, while on narrower looms each bar 14 can extend across the whole loom width. Each rail member 12 can be removed from the bolts 20 separately together with its lingoes still attached to the rail 13. An advantage of this is that the tension of the elastics 11 on one rail 13 is manageable. Furthermore, the disassembly and reassembly for cleaning purposes is simply a matter—in the illustrated case—of separately removing and replacing eight rail members 12, as compared to the task of removing and replacing hundreds of pins and having to reattach the elastics in their proper sequence according to the prior art arrangement.

By "elastic lingoes" is also to be understood spiral tension springs in addition to rubber-elastic or like material.

What we claim is:

1. An anchorage for elastic lingoes for use in a weaving loom, comprising:

support means; and a plurality of rail members adapted to receive a plurality of said lingoes along the length of said rail members, said rail members being supported in said support means so as to extend transversely of the loom adjacent and parallel one another wherein said support means supports said rail members such that said rail members are separately removable and replaceable with said lingoes still attached thereto.

2. An anchorage according to claim 1, wherein each of said rail members further comprises a rail adapted for attachment of said lingoes thereto, an elongate bar, and a plurality of supports for the rail disposed lengthwise of said bar, said bar being adapted for attachment to said support means.

3. An anchorage according to claim 2, wherein said support means further comprises a bolt fitted in apertures disposed along said support member.

4. An anchorage according to claim 3, wherein said bolts support said plurality of rails.

* * * * *